US006237845B1

(12) United States Patent
Hashimoto et al.

(10) Patent No.: US 6,237,845 B1
(45) Date of Patent: May 29, 2001

(54) PAPER CONTAINER AND METHOD FOR MANUFACTURING THE SAME

(75) Inventors: Masaru Hashimoto, Mebashi; Akira Nagashima, Maebashi; Jun Maekawa, Ohizumi-mura; Tomoko Fuse, Yasaka-mura, all of (JP)

(73) Assignee: Kuramae Sangyo Co., Ltd., Gunma-ken (JP)

( * ) Notice: Subject to any disclaimer, the term of this patent is extended or adjusted under 35 U.S.C. 154(b) by 0 days.

(21) Appl. No.: 09/401,979

(22) Filed: Sep. 23, 1999

(30) Foreign Application Priority Data

Apr. 27, 1999 (JP) ..... 11-119168

(51) Int. Cl.[7] ..... B65D 5/24
(52) U.S. Cl. ..... 229/400; 229/4.5; 229/186
(58) Field of Search ..... 229/4.5, 186, 400

(56) References Cited

U.S. PATENT DOCUMENTS

| | | | | |
|---|---|---|---|---|
| 396,028 | * | 1/1889 | Colhapp | 229/4.5 |
| 991,246 | * | 5/1911 | Rosenfeld | 229/400 |
| 1,101,589 | * | 6/1914 | Turnbull | 229/400 |
| 1,308,793 | * | 7/1919 | Luellen | 229/4.5 |
| 1,756,478 | * | 4/1930 | Batdorf | 229/4.5 |
| 1,864,835 | * | 6/1932 | Lackner | 229/400 |
| 2,041,437 | * | 5/1936 | Sidon | 229/400 |
| 2,304,278 | * | 12/1942 | Poster | 229/400 |
| 3,423,008 | * | 1/1969 | Mykleby | 229/186 |
| 3,833,113 | * | 9/1974 | Osier | 229/109 |
| 4,260,098 | * | 4/1981 | Manizza et al. | 229/186 |
| 5,351,879 | * | 10/1994 | Liu et al. | 229/400 |

* cited by examiner

*Primary Examiner*—Gary E. Elkins
(74) *Attorney, Agent, or Firm*—Townsend & Banta

(57) ABSTRACT

An improved paper container having a deep bottom which is formed from a single sheet of paper blank, and a method of making the same, is provided, which may be used as a drink container, food container or for any application requiring a container having strong, waterproof capabilities. Such a paper container is formed from a paper blank prepared by cutting a sheet of original paper in a predetermined shape, forming numerous ruled lines on the blank, folding along the ruled lines in various detailed steps, and finally curling back an upper face opening edge (serving as the mouth of the container).

1 Claim, 9 Drawing Sheets

PAPER CONTAINER AND METHOD FOR MANUFACTURING THE SAME

FIELD OF THE INVENTION

The present invention relates to a paper container made from a single sheet of paper blank and a method of making the same, which can be used as a food or drink container for such products as instant noodles, a flowerpot, or disposable drink cups, and which has a deep bottom and strong structural characteristics.

BACKGROUND OF THE INVENTION

Conventionally, easily formed plastic containers are often used for packaging and distributing foods and drinks or the like. Recently, however, paper containers have been reconsidered in view of various environmental problems encountered with the use of plastics such as outflow of environmental toxins, difficulty of plastic waste treatment after use, and the like. With regards to methods for manufacturing a paper container, there are well-known pasting and paper making methods. In one such conventional pasting method, for example, paper which has been subjected to a laminating process is used, two sheets of such paper each forming a barrel portion and a bottom portion of a container, respectively, and thereafter both sheets are subjected to adhesion with pressure and heat in a mold or other processing to be adhered and integrated together to form a container.

In another paper container making method, paper fibers are dispersed in water, the colloid solution thus obtained is filtered by a paper making net, paper material remaining on the paper making net is dehydrated to thereby make a prototype of a container, and thereafter the prototype of the container is hot air dried or heat pressed. In this method, however, there are drawbacks in that it is not only necessary to increase the number of steps and thus cost of manufacturing over the above pasting method, but also a container obtained by this method is weakened by water so that it cannot be used for a product requiring waterproofing such as a drink container or flowerpot.

For these reasons, there has conventionally been known a widely utilized drawing method for integrally forming a paper container integrally from a sheet of blank paper. According to this drawing method, containers having waterproof properties can be efficiently manufactured by using blank paper which has been subjected to lamination processing.

Since this type of paper container is formed integrally of a single sheet of blank paper, it can be relatively easily manufactured with a reduced number of steps. However, there are disadvantages in that setting conditions at the time of working are very severe. In particular, when the blank paper is subjected to deep drawing, the blank is injured. Accordingly, a conventional paper container obtained by the above drawing method has a shallow bottom and application thereof is restricted.

SUMMARY OF THE INVENTION

The present invention has been devised to overcome the above discussed disadvantages of the conventional paper containers, and an object thereof is to provide a paper container convenient for varied uses having a deep bottom, which is formed integrally of a single sheet of paper blank, and a method for manufacturing the same.

In order to achieve the above objects, the present invention provides a paper container formed of a single sheet of paper blank, wherein the paper container has a bottom face having a circular shape or a polygonal shape, an open upper face (serving as the mouth of the container), a peripheral wall face of the paper container comprising pleats and division faces formed alternately along a peripheral direction about the bottom face, which serves as the center of the container, side edges of the respective division faces are gathered upon one another and the division faces extend upwards towards an edge of the upper face opening, and the respective pleats are each formed in a double-folded triangular shape whose apex contacts with a peripheral edge of the bottom face and are folded on the respective division faces.

In a second embodiment of the present invention, a paper container is formed of a single sheet of paper blank, wherein the paper container has a bottom face having a circular shape or a polygonal shape and an open upper face, a peripheral wall face comprised of pleats having a double structure consisting of an inner wall folded in a cylindrical shape about the bottom face, which serves as the center of the container, and an outer wall surrounding the inner wall, respective upper ends of the inner wall and the outer wall being connected to each other as a folded-in portion, and the lower end of the outer wall projecting below the inner wall to serve as a supporting leg.

Furthermore, the present invention provides a method for manufacturing a paper container, comprising the steps of preparing a single sheet of paper blank by cutting the blank from an original paper in a predetermined shape, forming an annular ruled line of a regular polygonal shape at a central portion of the blank and forming V-shaped branch-like ruled lines spreading radially towards a peripheral edge of the blank from respective corners of the regular polygonal shape, dividing regions positioned between the respective branch-like ruled lines into two along symmetrical axial lines to make gusset portions and partitioning regions surrounded by the respective gusset portions as division faces, thereafter folding the annular ruled line in while folding the gusset portions in two along symmetry axial lines respectively to gather side edges of the respective division faces, forming a cylindrical body having an inside area defined by the annular ruled line, which serves as a bottom face, by folding the gusset portions constituting pleats on the respective division faces, and finally folding back an upper face opening edge of the cylindrical body outwardly (thus forming the lip of the mouth of the container).

DETAILED DESCRIPTION OF THE INVENTION

Figure 1:
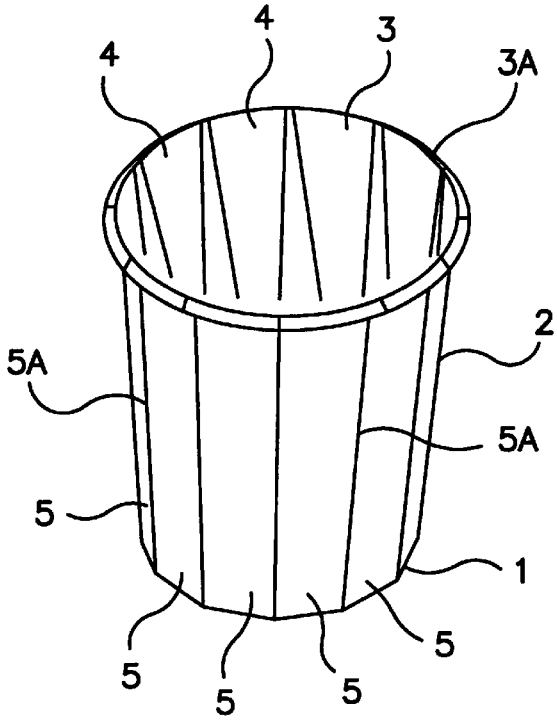
FIG. 1 is a perspective view of the first embodiment of a paper container according to the present invention.

A paper container is provided comprising a bottom face of the paper container 1, a peripheral wall 2 raised up from a peripheral edge of the bottom face 1, and an upper face 3 (which serves as the mouth of the container) opened at an upper portion of the peripheral wall 2, wherein the bottom face 1 is formed, for example, in a regular twelve-angle shape, and an upper face opening edge 3A is subjected to outward curling. The peripheral wall face 2 comprises a plurality of pleats 4 and a plurality of division faces 5 formed alternately about the bottom face 1.

Figure 2:
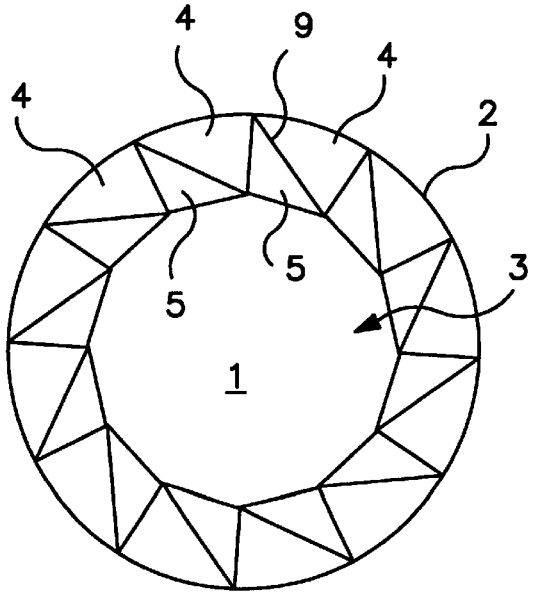
FIG. 2 is a plan view of the paper container shown in FIG. 1.
Figure 3:
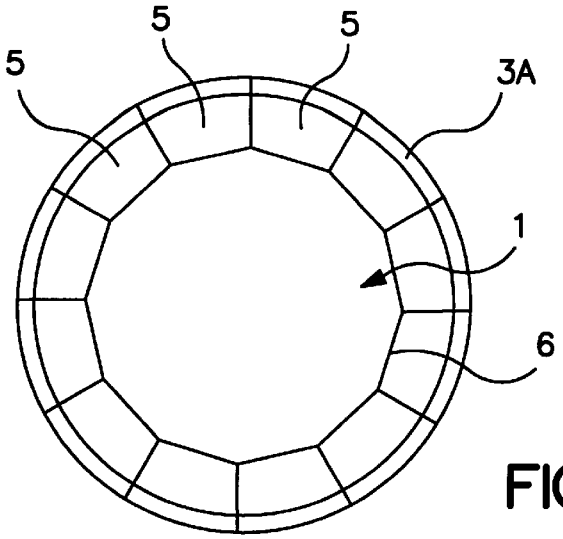
FIG. 3 is a bottom view of the paper container shown in FIG. 1.

The respective division faces 5 are each formed in a rectangular strip shape extending from the peripheral edge of the bottom face 1 towards the upper face opening edge 3A, division faces 5 are connected to one another through the pleats 4 positioned between adjacent division faces 5, and side edges 5A of the division faces 5 are gathered against each other. As shown in FIG. 2, the pleats 4 are each formed in a double-folded triangular shape whose apexes contact with the peripheral edge (each corner portion) of the bottom face 2, the pleats 4 and the respective division faces 5 are mutually interposed between one another, and the pleats 4 are folded along the respective division faces 5 thereon.

Figure 4:
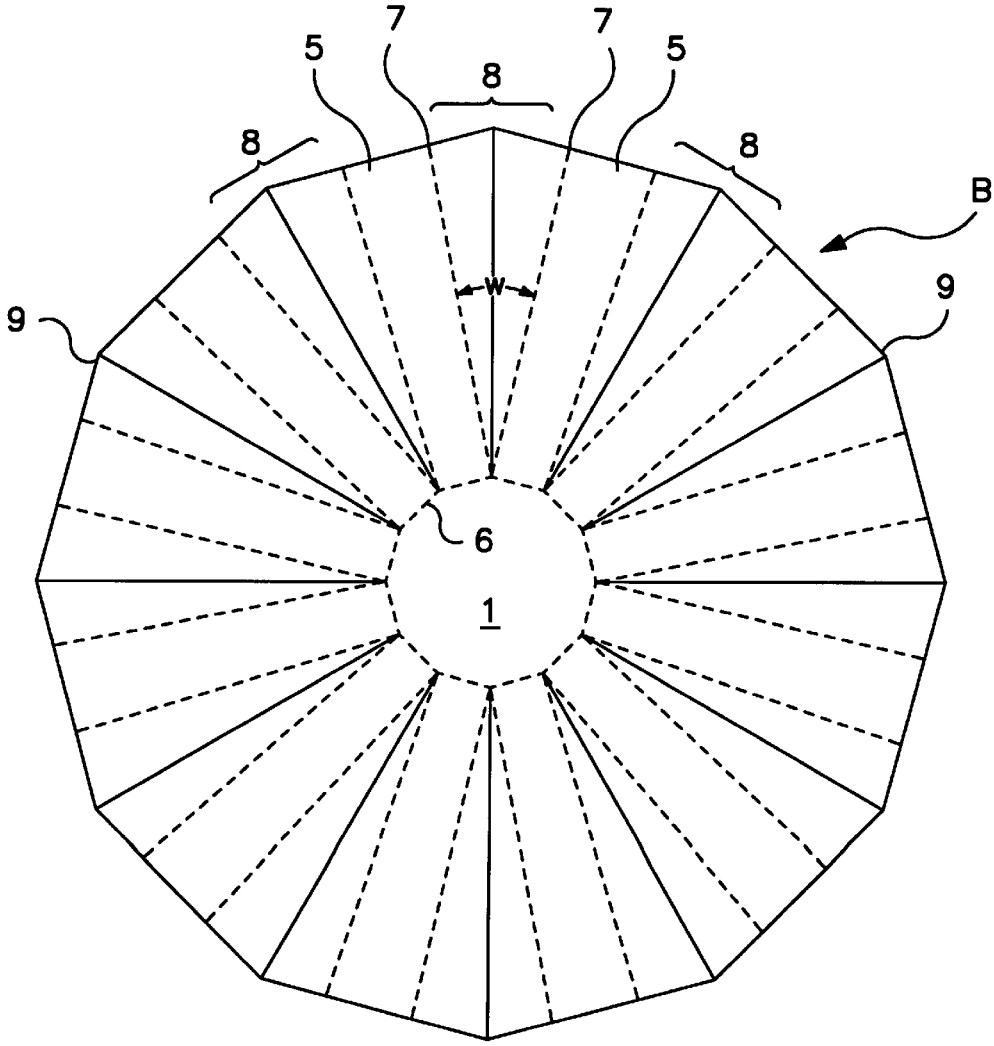
FIG. 4 is a plan view of the blank B used to form the paper container shown in FIG. 1.

The paper container thus structured is manufactured by using paper coated with a synthetic resin film or other water repellent material as a blank, and thus the paper container can be utilized, for example, as a container for food, such as instant noodles, drinks, a flowerpot, or the like. However, application of the paper container of the present invention above should not be limited to the above, as various applications are possible. As shown in FIG. 4, upward-folding lines are represented with broken lines and downward-folding lines are represented with narrow lines. The bottom face 1 is partitioned by an annular ruled line 6 forming a regular twelve-angle shape positioned at a central portion of a blank B, and gusset portions 8 forming the pleats 4 by V-shaped branch-like ruled lines 7, 7 extending radially from respective corners of the annular ruled line 6 and the strip-shaped division faces 5 are partitioned at equal intervals along the peripheral direction of the blank B.

In particular, as shown in FIG. 4, the blank B has a regular twelve-angle shape congruent to the bottom face 1 (the annular ruled line 6), and symmetry axial lines 9 for making the pleats 4 by double-folding the gusset portions 8 between the respective corners of the blank B and the respective corners of the annular ruled line 6 are formed in the blank B. The respective division faces 5 are formed in trapezoidal shapes, each having one side (bottom) forming part of the annular ruled line 6, and the division faces 5 and the respective gusset portions 8 are mutually alternately formed.

It should be noted that the angle w formed by the branch-like ruled lines 7, 7, as shown in FIG. 4, is illustrated as 24°, but an opening degree of the upper face of the finished paper container can be enlarged/reduced by changing the angle w. For example, when the angle w shown in FIG. 4 is less than 24°, the taper angle of the paper container is increased, i.e., a paper container having a wider mouth may be obtained. On the other hand, when the angle w is made greater than 24°, spreading of the paper container towards the upper face side thereof is decreased so that the shape of the paper container more closely resembles a regular cylindrical shape, and, at some point when the angle w grows large enough, the width of the paper container will taper towards the mouth.

Figure 5:
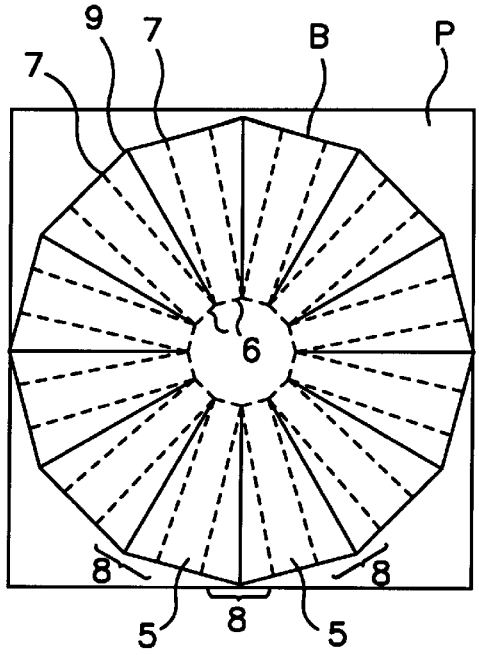
FIG. 5 is a plan view showing a state of blank B used to form the paper container shown in FIG. 1 before the blank B is cut out from an original paper.

As shown in FIG. 5, a blank B is cut from an original paper P in a predetermined shape, particularly a twelve-angle shape in this embodiment, by a cutting die or the like, thereby forming the blank B. Such a cutting die may not only have a cutting edge but also a means to form ruled lines. For example, ruled lines such as the annular ruled line 6 used as a guide for upward folding, the branch-like ruled lines 7 used as a guide for forming gusset portions, and the symmetry axial lines 9 used as guides for for downward folding are formed on the blank B simultaneously with forming of the blank B.

It is to be noted that the annular ruled line 6, which forms a twelve-angle shape, is formed on a central portion of the blank B and the branch-like ruled lines 7 are formed in a V-shape spreading radially towards the peripheral edge of the blank B from the respective corners of the annular ruled line 6. In this manner, as shown in FIG. 4, the regions inside the respective branch-like ruled lines 7 each formed in the V-shape form the gusset portions 8, and the respective gusset portions 8 and the strip-shaped division faces 5 formed mutually are partitioned alternately around the periphery of the annular ruled line 6. The linear symmetrical axial lines 9 serve to divide the respective gusset portions 8 in two, and are formed so as to extend from the respective corner portions of the annular ruled line 6 to the respective corner portion of the blank B.

Figure 6:
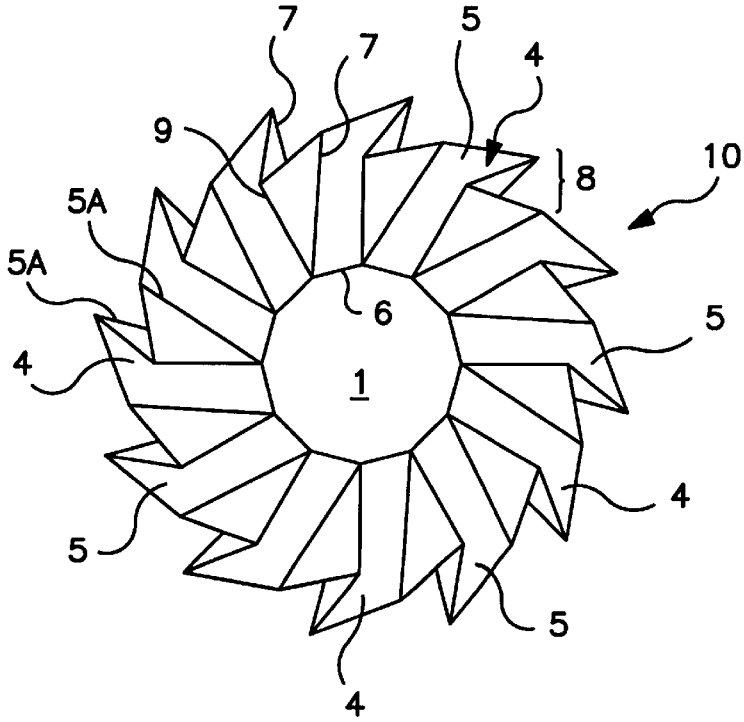
FIG. 6 is a plan view of the paper container of the present invention, showing a state where the blank is partially folded into a cylindrical shape.
Figure 8:
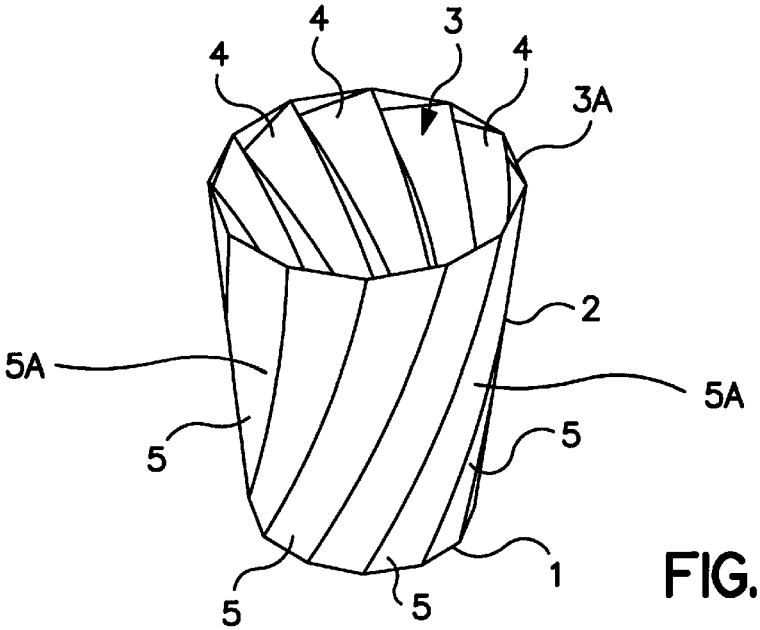
FIG. 8 is a perspective view showing a third embodiment of a paper container according to the present invention.

Accordingly, as shown in FIG. 6, while the respective branch-like ruled lines 7 are folded upwardly and the symmetry axial lines 9 are folded downwardly so that the respective gusset portions 8 are double folded, the annular ruled line 6 is folded in upwardly so that the side edges 5A, formed by the branch-like ruled lines 7 of the respective division faces 5 are gathered. At this time, the respective pleats 4 formed by the double-folded gusset portions 8 are folded upon the inner faces of the respective division faces 5. Then, the upper face opening edge 3A, as shown in FIG. 8, of cylindrical body 10 is folded back outwardly by curling, which can be easily performed by conventional forming machines, so that the paper container as shown in FIG. 1 can be obtained.

This type of paper container can also be automatically formed by a cavity having protruded strips for folding the symmetry axial lines 9 in, and a punch having grooves for receiving the respective pleats 4 formed by the double folded gusset portions 8. In particular, rotating the punch is thought of as a means for folding the pleats 4 on the division faces 5. Importantly, when the upper face opening edge is folded back outwardly by curling or the like, the present invention provides an advantage in that the respective pleats 4 are maintained in a folded state along the division faces 5, so that the upper face opening edge 3A is prevented from spreading, and thus the paper container of the present invention can be maintained in its defined shape without using any adhesive. However, adhesive may be used when not folding the upper face opening edge 3A in, wherein the respective pleats 4 are pasted on the division faces 5.

The paper container according to the present invention is not limited to one where a bottom face has a regular twelve-angle shape as described above, and the bottom face, the peripheral wall face and the upper face may be formed in a substantially circular shape, in a polygonal shape, including a triangular shape or rectangular shape up to a twenty-four-angle shape or so, and especially regular polygonal shapes thereof.

Figure 7:
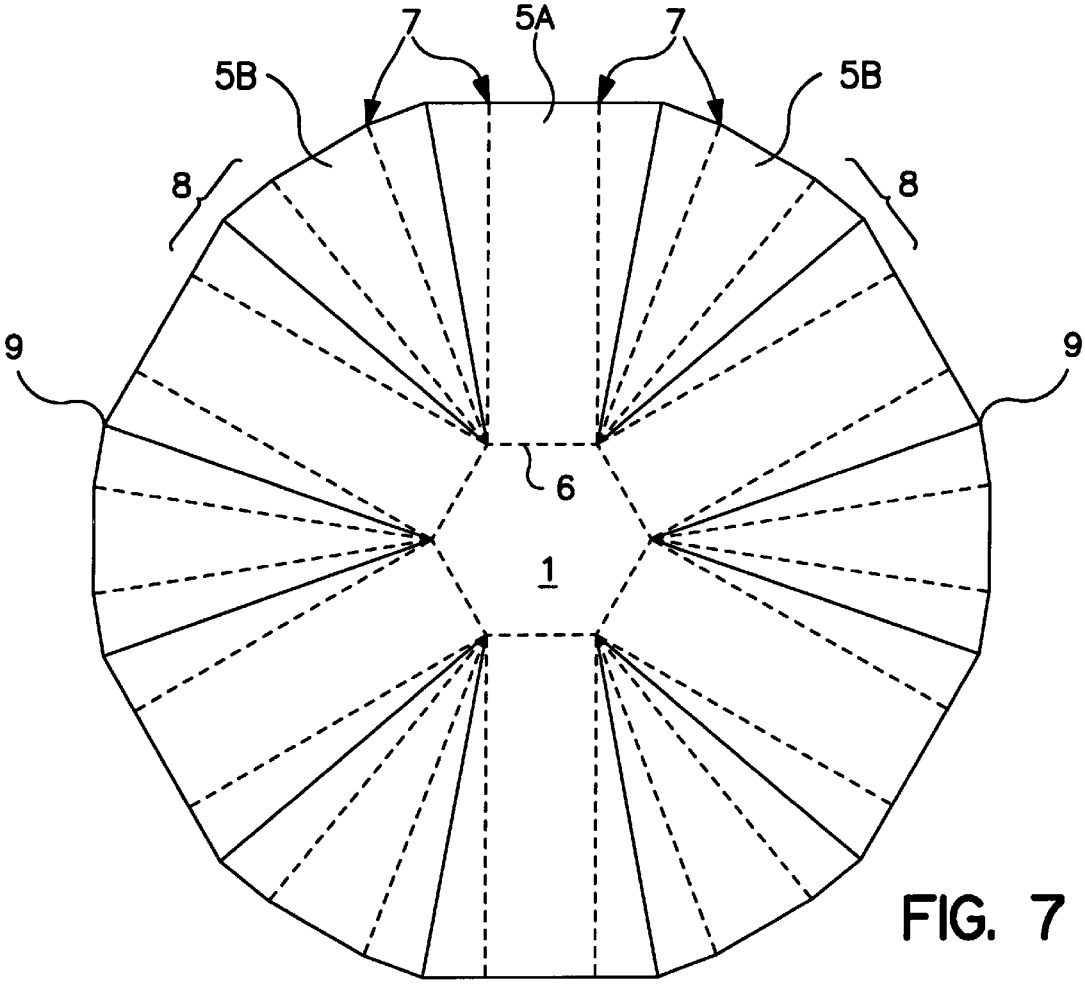
FIG. 7 is a plan view of the blank used to form the second embodiment of the paper container according to the present invention.

For example, FIG. 7 is a top view of the blank for forming a paper container having a bottom face 1 of a rectangular hexagon. In this example, two branch-like ruled lines 7 formed in a V-shape from respective corner portions of an annular ruled line 6 forming the regular hexagon are formed radially, regions between the respective branch-like ruled lines 7 form gusset portions 8, rectangular strip-shaped division faces 5A having one side which forms a respective side of the annular ruled line 6, and triangular-shaped division faces 5B whose apexes form the respective corners of the annular ruled line 6 are formed alternately via the gusset portions 8.

The paper container formed by the blank shown in FIG. 7 can also be formed into a seamless cylindrical shape by folding in the annular ruled line 6, the branch-like ruled lines 7 and the symmetry axial lines 9, respectively. Then, the side edges (the branch-like ruled lines 7) of the division faces 5A and 5B are gathered, the gusset portions 8 are formed in double-folded pleats, and the gusset portions 8 are folded on the respective division faces 5A and 5B.

Figure 9:
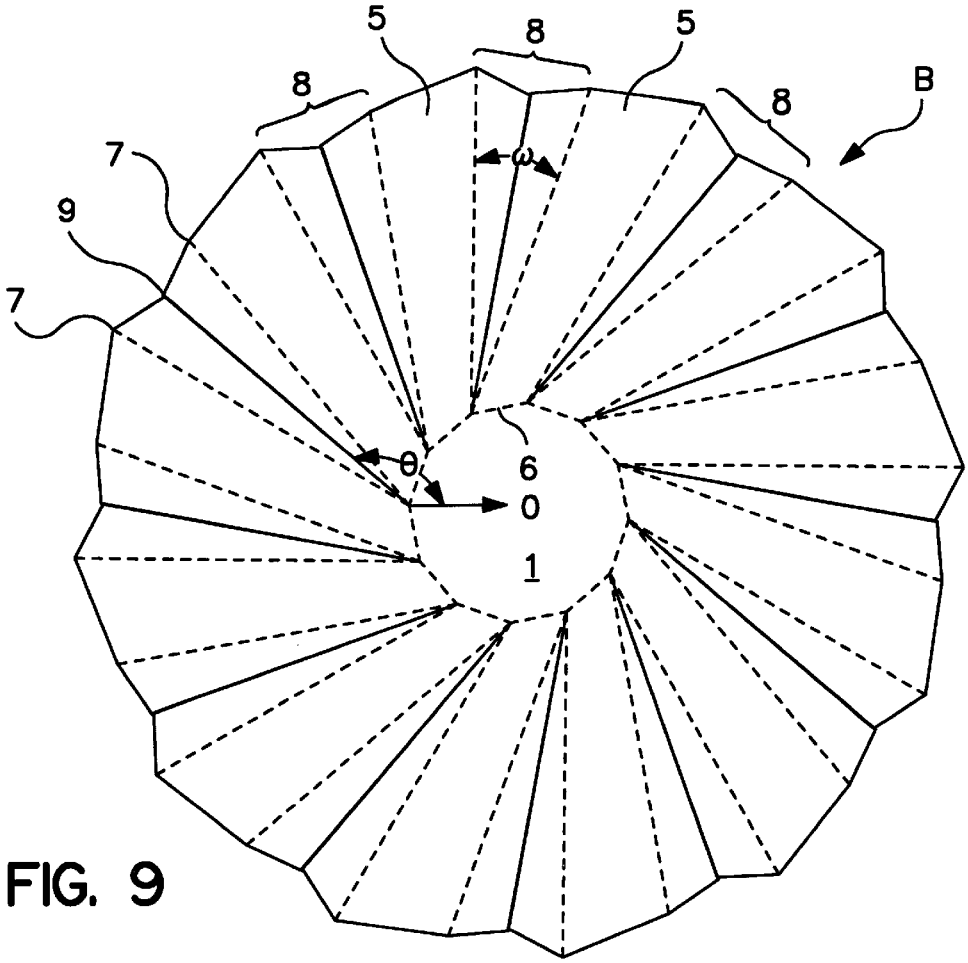
FIG. 9 is a plan view of the blank B used to form the paper container shown in FIG. 8.

As shown in FIG. 8, respective division faces 5 are formed with a predetermined inclination inward from the bottom face 1 towards the peripheral direction. Here, a paper container as shown in FIG. 8 is formed from blank B shown in FIG. 9. The annular ruled line 6, shown in FIG. 9, is formed on a central portion of the blank B, and the gusset portions 8 forming the double-folded pleats 4 and the division faces 5 are formed about the annular ruled line 6. That is, the V-shaped branch-like ruled lines 7, 7 spreading radially from the respective corner portions of the annular ruled lines 6 are formed such that the symmetry axial lines 9 forming central lines between the V-shaped ruled lines 7, 7 form an obtuse angle to a central point O of the annular ruled line 6. Thus, seamless cylindrical paper container, as shown in FIG. 8, can be easily manufactured by folding such a blank B as described above. As shown in FIG. 9, the upper face opening edge 3A can be flattened by forming the outer peripheral edge of the blank B in a petal shape. However, it should be noted that, though the paper container shown in FIG. 8 is not subjected to any processing on the upper face opening edge 3A, the upper face opening edge 3A may also be folded back outwardly by curling or the like in this embodiment.

Figure 10:
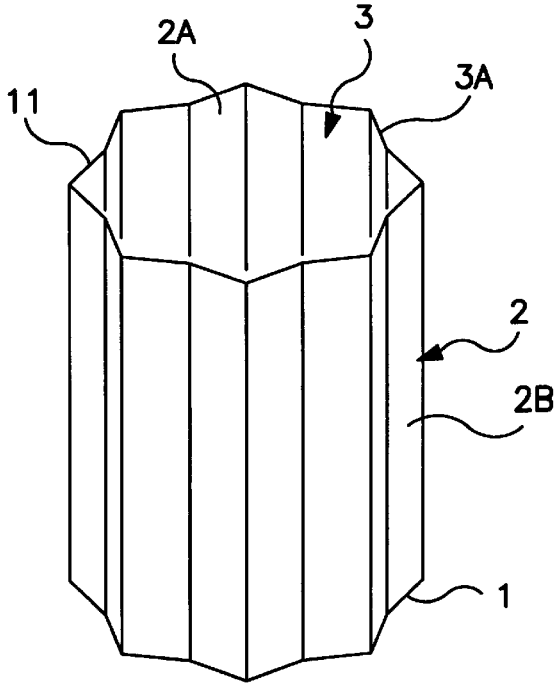
FIG. 10 is a perspective view showing a fourth embodiment of a paper container according to the present invention.
Figure 11:
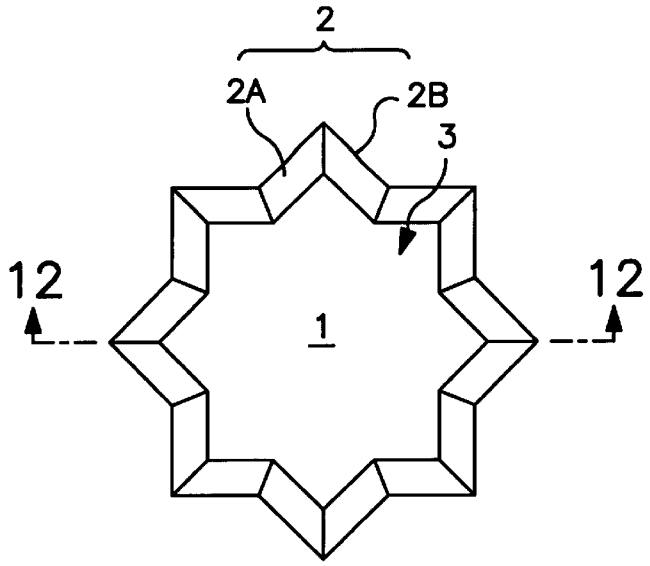
FIG. 11 is a plan view of the paper container shown in FIG. taken along axis X—X shown in FIG. 10.
Figure 12:
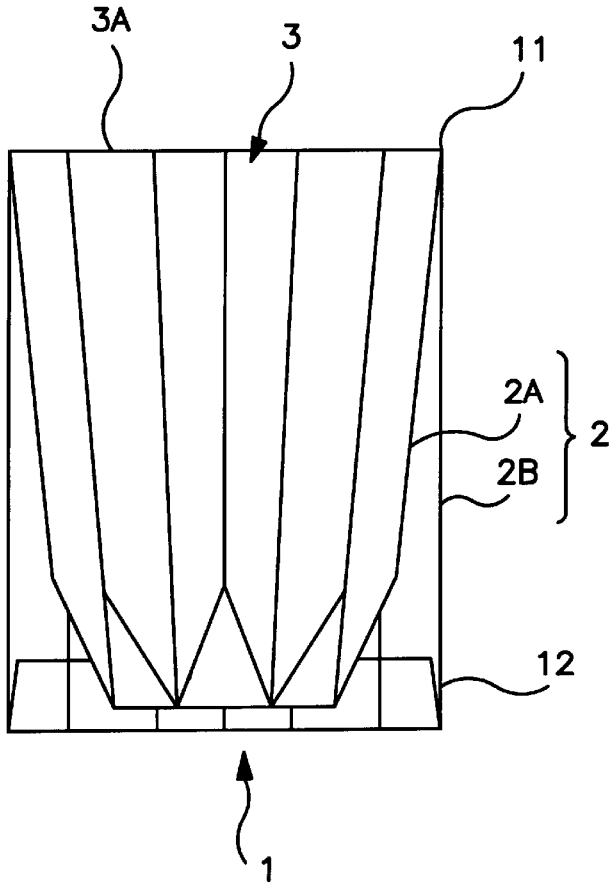
FIG. 12 is a side view taken along line X—X of the paper container shown in FIG. 11.

In another embodiment of the present invention, as shown in FIGS. 10 to 16, a paper container is provided with a bottom face 1 having a sixteen angle star shape, which can be formed into an integral cylindrical body having a bottom, from a sheet of paper blank without providing a margin to paste up. In particular, as shown in FIG. 12, the paper container of this embodiment has a double structure wherein the peripheral wall face 2 comprises an inner wall 2A and an outer wall 2B are folded in a corrugated manner. The respective upper ends of the inner wall 2A and the outer wall 2B are connected to each other at folded portion 11 which forms on the upper face opening edge 3A, and the lower end of the outer wall 2B projects below the inner wall 2A to serve as a supporting leg 12. In particular, the lower end of the outer wall 2B is folded inwardly a predetermined width so as to prevent shape collapse.

Figure 13:
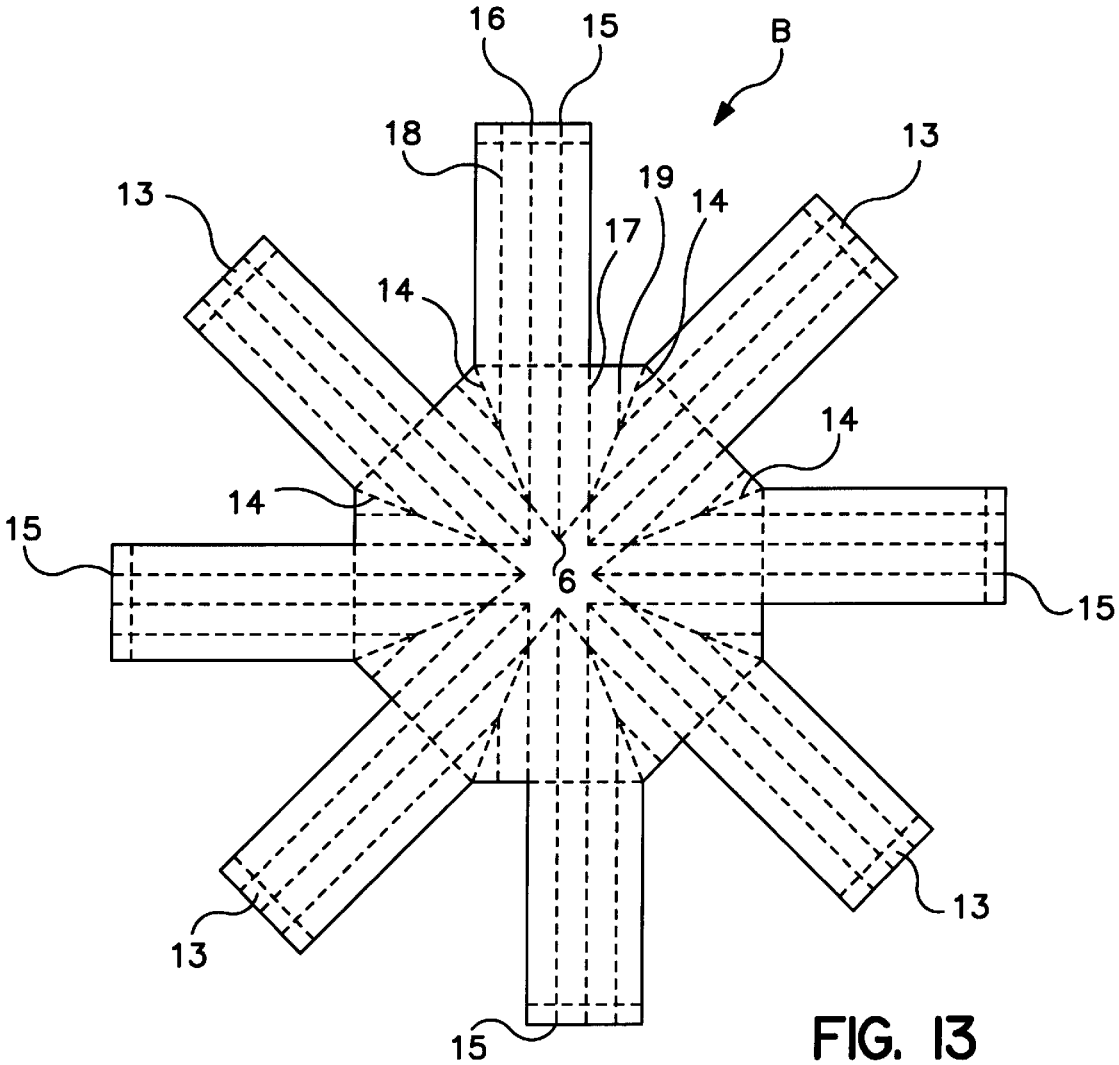
FIG. 13 is a plan view of the blank B used to form the paper container shown in FIG. 10.

FIG. 13 showing the blank B, which is cut from an original paper and is used to form the paper container is discussed above, has projecting pieces 13 forming the outer wall 2B, and has a configuration such that the rectangular projecting pieces 13 extend radially from the respective sides of a regular eight-angle shape. An annular ruled line 6, for partitioning the bottom face 1 and the peripheral wall face 2 from each other, is formed on the blank B.

A plurality of folding lines 14 and 15 are formed radially from convex corners and concave corners of the blank B towards the peripheral edge of the blank B. Furthermore, folding lines 16 and 17 extending from the convex corner of the annular ruled line 6 are formed in parallel with the folding line 15, and folding lines 18 and 19 extending from the folding line 14 are formed in parallel with the folding line 15. In particular, the folding lines 15 to 19 are formed at equal intervals, the folding line 17 intersects with one side of the projecting piece 13, and the folding line 14 intersects with another side of the projecting piece 13.

Figure 14:
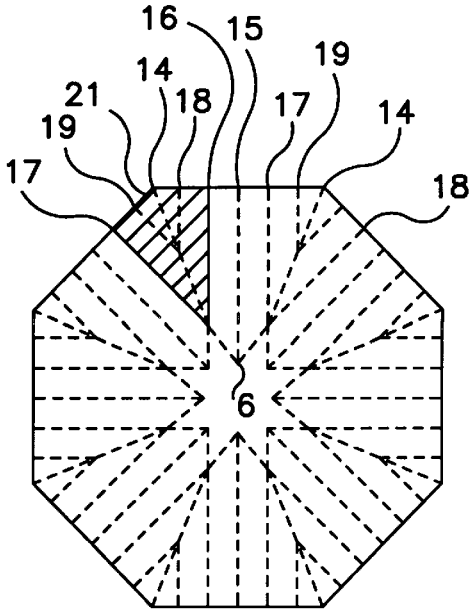
FIG. 14 is a plan view showing a first manufacturing step for forming the paper container shown in FIG. 10.
Figure 15:
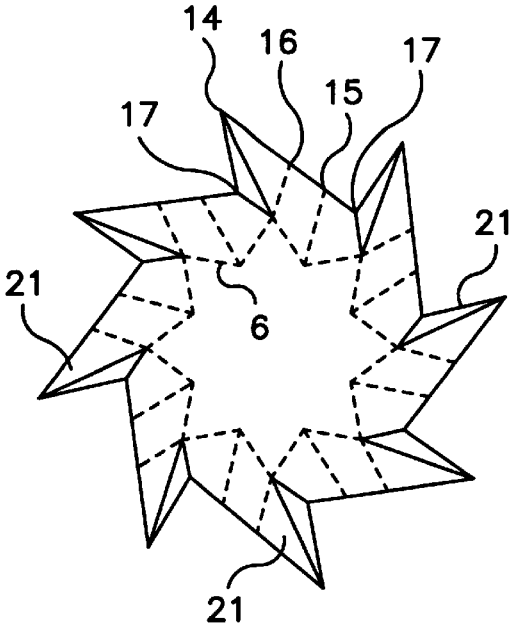
FIG. 15 is a plan view showing a second manufacturing step for forming the paper container shown in FIG. 10.
Figure 16:
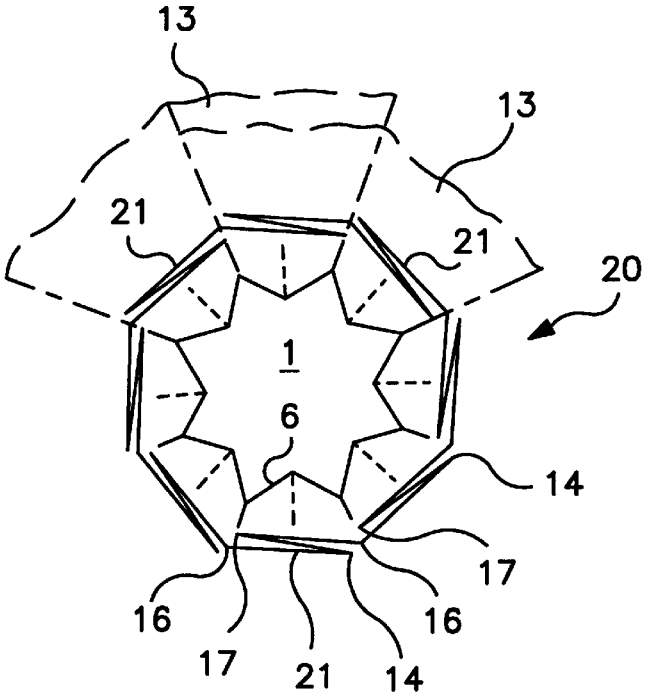
FIG. 16 is a plan view showing a third manufacturing step for forming the paper container shown in FIG. 10.

For forming the paper container shown in FIGS. 10 to 12 from blank B shown in FIG. 13, the respective projecting pieces 13 are first folded back outwardly to form such a shape as shown in FIG. 14, and then folding lines 17 are folded downwardly while the folding lines 14 are folded upward, thereby forming folding habits as shown in FIG. 15. Thereafter, while keeping one projecting piece 13 in place, an alternating projecting piece 13 is folded up, and while the projecting piece 13 as is folded is folded upward along the folding line 16, the other projecting piece adjacent to one side outer surface of this projecting piece 13 is folded on the adjacent projecting piece 13. A cylindrical body 20 of a regular eight-angle shape, as shown in FIG. 16, is obtained by repeating this procedure with all projecting pieces 13.

Then, the region positioned between the folding lines 16 and 17 is folded between the outer wall 2B and the same while forming the cylindrical inner wall 2A as double-folded pleats 21 having the folding line 14 as a ridge line. The respective projecting pieces 13 thus form the outer wall 2A surrounding the inner wall 2A, and the lower ends project below the inner wall 2A to form the supporting leg 12. The lower end of the outer wall 2A is folded inside, and the folding lines 15 are folded downwardly so that a paper container having a bottom face 1 with a sixteen angle star-shape, as shown in FIGS. 10 to 12, can be obtained.

The above manufacturing method is only one possible example, and other manufacturing methods may be used to construct the paper container of the present invention. Specifically, the above manufacturing method shows a manual method of manufacture, but it is possible to automatically manufacture the paper container of the present invention by devising dies or the like for manufacture of the paper containers of the present invention.

Figure 17:
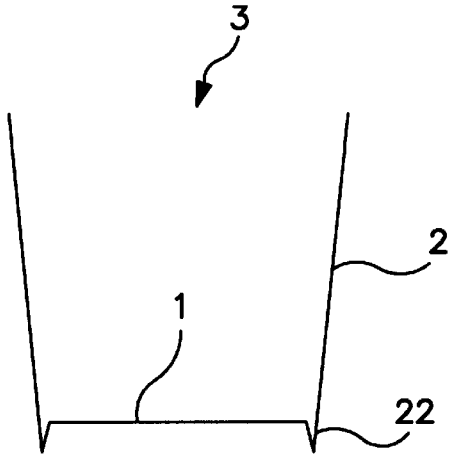
FIG. 17 is a side view schematically showing a fifth embodiment of a paper container according to the present invention.
Figure 18:
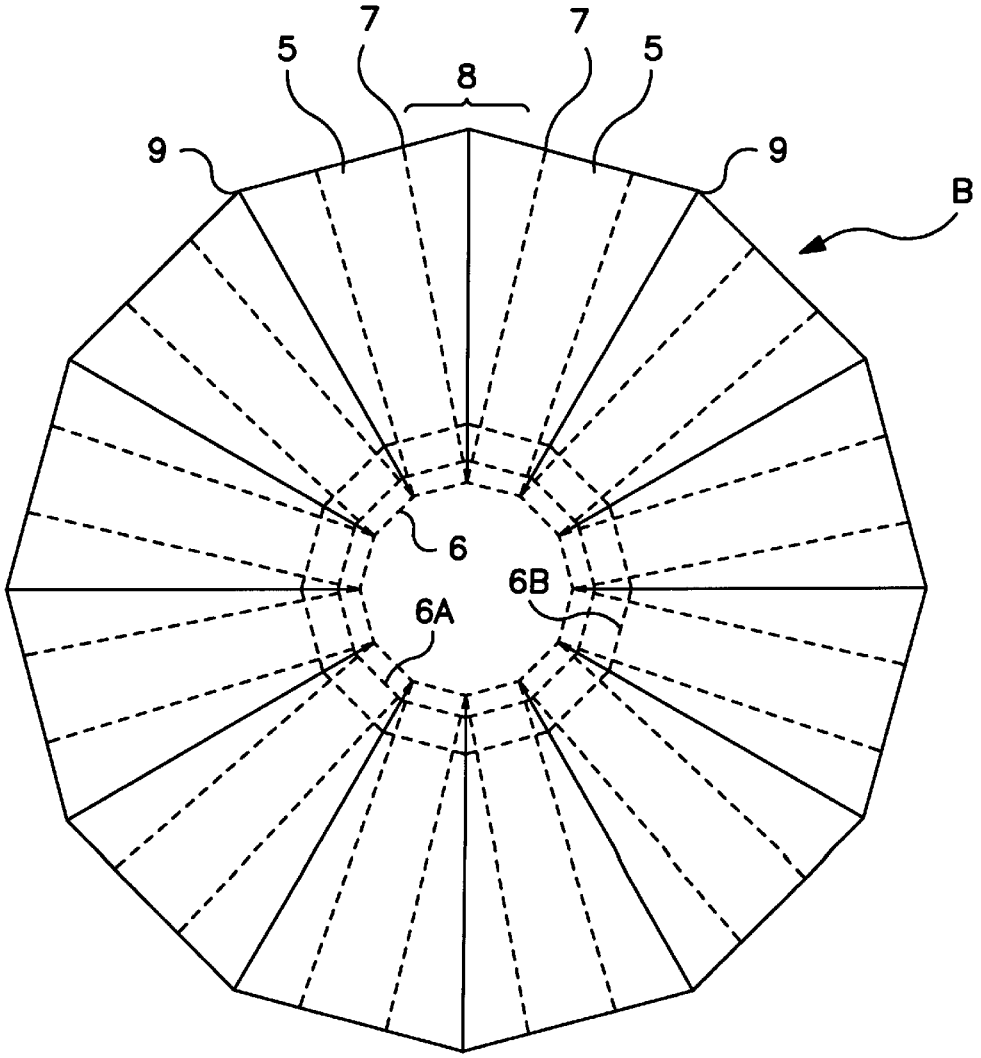
FIG. 18 is a plan view of the blank B used to form the paper container shown in FIG. 17.

A further embodiment of the paper container according to the present invention is provided, as shown in FIG. 17, wherein a supporting leg 22 is formed at the lower end of the peripheral wall face 2 so that the bottom of the paper container is raised above a supporting surface and is manufactured from the blank B shown in FIG. 18. Namely, in contrast to the blank B shown in FIG. 4, this paper container can be manufactured from a blank B having two other annular ruled lines 6A and 6B for forming a supporting leg concentrically formed about the annular ruled line 6.

Therefore, in contrast to conventional plastic and paper containers, the present invention provides a paper container having a deep bottom which can be easily manufactured without injuring the blank, with a central portion of a sheet of blank left unfolded to form the bottom of the paper container, and a resulting cylindrical shaped container made by forming pleats about the central portion by gusset folding, wherein a paper container.

Furthermore, since the paper container is formed integrally of a single sheet of paper blank, waterproofing techniques can be applied to the paper container such that the paper container may be used as a drink container, which is far superior to the paper containers obtained by conventional paper making methods. In addition, since the paper container has pleats which have been folded on the peripheral wall face, high strength and a more aesthetically pleasing appearance are obtained. Moreover, since the upper face opening edge is subjected to curling, the paper container can maintain its own defined shape without using adhesive.

Reference numerals

1 bottom face
2 peripheral face
3 upper face
3A upper face opening edge
4 pleat
5 division face
6 annular ruled line
7 branch-like ruled line
8 gusset portion
9 symmetry axial line
10 cylindrical body
11 folded-in portion
12 supporting leg

What is claimed is:

1. A paper container formed integrally of a single sheet of blank paper, said paper container comprising:

a bottom face having a circular shape or a polygonal shape and a peripheral edge thereon;

a peripheral wall raised up from the peripheral edge of the bottom face having an upper face opening edge, said peripheral wall defining an interior and exterior portion of the paper container; and a mouth having a diameter defined by the upper face opening edge of the peripheral wall, said peripheral wall comprising double-folded triangular shaped pleats being folded so as to be maintained in the interior portion of the paper container whose apexes contact with the peripheral edge of the bottom face formed alternately and interposed between division faces formed alternately along a peripheral direction about the bottom face, side edges of respective division faces being gathered upon one another and extending towards the upper face opening edge, wherein said division faces are formed with a predetermined inclination inward from the bottom face in the peripheral direction so that the paper container tapers towards the mouth of the container.

* * * * *